US005765832A

United States Patent [19]

Huff

[11] Patent Number: 5,765,832

[45] Date of Patent: Jun. 16, 1998

[54] CHANGEABLE TARGET GAME APPARATUS

[76] Inventor: Walter M. Huff, 190 Station Way, Brooks, Ky. 40109

[21] Appl. No.: 845,910

[22] Filed: Apr. 28, 1997

[51] Int. Cl.[6] ..... A63B 63/04

[52] U.S. Cl. ..... 273/354; 273/402

[58] Field of Search ..... 273/400, 402, 273/354, 368, 369, 401

[56] References Cited

U.S. PATENT DOCUMENTS

| | | | |
|---|---|---|---|
| 1,616,270 | 2/1927 | Madden | 273/354 |
| 2,886,321 | 5/1959 | Tarte, Jr. | 273/354 |
| 3,794,318 | 2/1974 | Holmes | 273/354 |
| 4,726,591 | 2/1988 | Johnson | 273/339 |
| 4,936,590 | 6/1990 | Palmer | 273/402 |
| 4,938,485 | 7/1990 | Hockridge et al. | 273/402 |
| 4,943,065 | 7/1990 | DeLapa | 273/402 |
| 5,050,889 | 9/1991 | Walker | 273/402 |
| 5,056,797 | 10/1991 | Hockert | 273/402 |
| 5,201,527 | 4/1993 | Koket | 273/402 |
| 5,332,230 | 7/1994 | Benedict | 273/402 |

FOREIGN PATENT DOCUMENTS

| | | | |
|---|---|---|---|
| 634867 | 2/1962 | Italy | 273/354 |

*Primary Examiner*—Mark S. Graham
*Attorney, Agent, or Firm*—Henderson & Sturm

[57] ABSTRACT

A changeable target game apparatus 10 including a collapsible housing member 20 having a forwardly angled target impact panel 21 provided with an enlarged apertures 28 and a target member 30 rotatably disposed on the target impact panel 21 and provided with a plurality of different sized openings 32, 33, 34 which are selectively alignable with the enlarged aperture 28 in the target impact panel 20.

5 Claims, 1 Drawing Sheet

CHANGEABLE TARGET GAME APPARATUS

BACKGROUND OF THE INVENTION

1. Field of the Invention

The present invention relates to the field of bag toss games in general, and in particular to a bag toss game that incorporates a changeable target area into the game apparatus.

2. Description of Related Art

As can be seen by reference to the following U.S. Pat. Nos. 4,726,591; 4,936,590; 5,050,889; and 5,201,527, the prior art is replete with myriad and diverse collapsible game toss devices.

While all of the aforementioned prior art constructions are more than adequate for the basic purpose and function for which they have been specifically designed, they are uniformly deficient with respect to their failure to provide a simple, efficient, and easy to use changeable target area on the game playing surface.

As anyone who is familiar with these types of game devices is aware, the individuals who play the conventional fixed size target on a regular basis versions soon become adept at tossing the bag through the target at will, which eliminates the challenge of the game and causes the players to lose interest in continuing to play the game.

As a consequence of the foregoing situation, there has existed a longstanding need for a new and improved type of bag toss game apparatus that has a changeable target area that can be varied to accommodate players having different skill levels and the provision of such a construction is a stated objective of the present invention.

BRIEF SUMMARY OF THE INVENTION

Briefly stated, the changeable target game apparatus that forms the basis of the present invention comprises in general a housing unit and a target unit operatively associated with the upper portion of the housing unit.

As will be explained in greater detail further on in the specification, the collapsible housing unit includes a plurality of hinged panels that are operatively connected to one another by a plurality of corner connector members.

In addition, the housing unit is further provided with a target impact surface having an aperture formed therein. The target unit is provided with a plurality of different sized apertures which are selectively brought into registry with the aperture in the target impact surface to vary the size of the target opening in the game apparatus.

BRIEF DESCRIPTION OF THE SEVERAL VIEW OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figures 1, 2, 3:
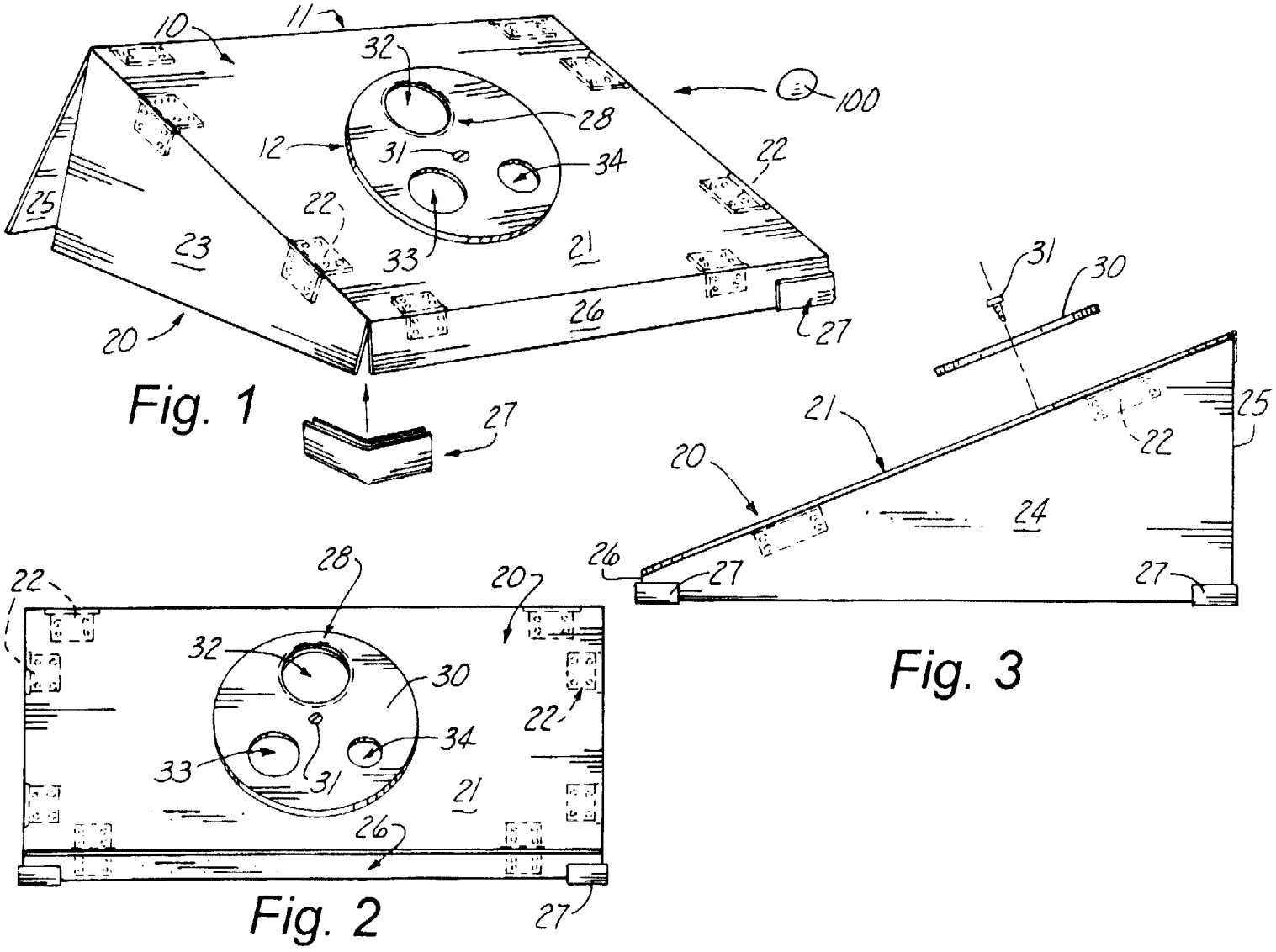
FIG. 1 is a perspective view of the changeable target game apparatus that forms the basis of the present invention.
FIG. 2 is a front plan view of the game apparatus.
FIG. 3 is an exploded side plan view of the apparatus.

As can be seen by reference to the drawings, and in particularly to FIG. 1, the changeable target game apparatus that forms the basis of the present invention is designated generally by the reference number 10. The game apparatus 10 comprises in general a collapsible housing unit 11 and a target unit 12. These units will now be described in seriatim fashion.

As shown in FIGS. 1 through 3, the housing unit 11 comprises a collapsible housing member 20 including an enlarged generally rectangular target impact panel 21 hingedly connected as at 22 to a pair of angled side panels 23, 24, an enlarged generally rectangular rear panel 25, and an elongated relatively narrow front panel 26.

As can best be seen by reference to FIGS. 1 and 2, the collapsible housing member 20 further includes a plurality of angled corner connector elements 27 which are used to connect the side panels 23, 24 to the front 26 and the rear 25 panels in a well recognized fashion.

In addition, the target impact panel 21 is further provided with an enlarged aperture 28 depicted in phantom in FIGS. 1 and 2, whose purpose and function will be described presently.

Returning once more to FIGS. 1 through 3, it can be seen that the target unit 12 comprises a generally circular changeable target member 30 rotatably disposed as at 31 on the target impact panel 21. The target member 30 is dimensioned to always overlie the enlarged aperture 28 on the target impact panel 21.

In addition, as shown in FIGS. 1 and 2, the changeable target member 30 is provided with progressively smaller circular openings 32, 33, 34, which are radially aligned around the periphery of the target member 30 and dimensioned to be rotated into registered alignment with the enlarged aperture 28 on the target impact panel 27.

Due to the hinged arrangement between the target impact panel 21, the side panels 23, 24, the rear panel 25, and the front panel 26, the game apparatus 10 can be collapsed down into a very compact space when not in use. However, when it is desired to play the game, the apparatus 10 would be unfolded and the corner connector elements 27 engaged in a well recognized fashion to operatively deploy the game apparatus 10.

At this juncture, the user would selectively register one of the different sized openings 32, 33 or 34 with the enlarged aperture 28 on the forwardly sloped top target impact panel 21 to establish the degree of difficulty in tossing an object 100 such as a ball, bean bag, coin, token, etc. through the selected opening such as 32 and into the interior of the housing member 20. Obviously, the degree of difficulty will be inversely proportional to the size of the particular opening 32, 33, or 34 chose.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A changeable target game apparatus consisting of:

a housing unit including a housing member having a target impact panel equipped with a single enlarged aperture; and a target unit operatively associated with said target impact panel and comprising a generally circular target member rotatably disposed on the target impact panel and provided with a plurality of different sized circular openings which are individually alignable with said single enlarged aperture to vary the effective size of said single enlarged aperture.

2. The game apparatus as in claim 1 wherein said housing member is collapsible and includes a pair of angled side panels hingedly connected to said target impact panel.

3. The game apparatus as in claim 2 wherein said housing member further includes a front panel and a rear panel hingedly connected to said target impact panel.

4. The game apparatus as in claim 1 wherein said housing unit includes an enlarged rear panel and a relatively narrow front panel hingedly connected to said target impact panel.

5. The game apparatus as in claim 3 wherein said side panels are operatively connected to said front and rear panel by a plurality of angled corner connector elements.

* * * * *